US007706710B2

(12) United States Patent
Funahashi

(10) Patent No.: US 7,706,710 B2
(45) Date of Patent: Apr. 27, 2010

(54) IMAGE FORMING APPARATUS

(75) Inventor: Norimichi Funahashi, Nisshin (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 549 days.

(21) Appl. No.: 11/688,587

(22) Filed: Mar. 20, 2007

(65) Prior Publication Data

US 2007/0230985 A1 Oct. 4, 2007

(30) Foreign Application Priority Data

Mar. 30, 2006 (JP) ..... 2006-095016

(51) Int. Cl.
*G03G 15/00* (2006.01)

(52) U.S. Cl. ..... 399/80

(58) Field of Classification Search ..... 399/80, 399/82, 2

See application file for complete search history.

(56) References Cited

U.S. PATENT DOCUMENTS

| | | | | |
|---|---|---|---|---|
| 5,321,485 | A | 6/1994 | Nukaya | |
| 7,564,575 | B2 * | 7/2009 | Takegoshi | 399/82 |
| 7,613,412 | B2 * | 11/2009 | Harada et al. | 399/80 |
| 2006/0209359 | A1 | 9/2006 | Kadowaki | |

FOREIGN PATENT DOCUMENTS

| | | |
|---|---|---|
| JP | 05-316261 | 11/1993 |
| JP | 5-342479 | 12/1993 |
| JP | 06-113053 | 4/1994 |
| JP | 2004-017624 | 1/2004 |
| JP | 2004-188772 | 7/2004 |
| JP | 2004-312302 | 11/2004 |
| JP | 2005-102110 | 4/2005 |
| JP | 2005-193478 | 7/2005 |
| JP | 2006-031485 | 2/2006 |

OTHER PUBLICATIONS

Notice of Reasons for Rejection for Japanese Application No. 2006-095016, mailed Feb. 23, 2010.

* cited by examiner

*Primary Examiner*—Susan S Lee
(74) *Attorney, Agent, or Firm*—Banner & Witcoff, Ltd

(57) ABSTRACT

The image forming apparatus preferably includes a process unit, an acquisition unit, a detection unit, and a selection unit. The process unit executes processes in a plurality of modes corresponding to identification information for identifying a user. The acquisition unit acquires identification information for identifying a user. The detection unit detects presence or absence of an object to be used in at least any one of the plurality of modes. The selection unit selects a mode corresponding to the presence or absence of the object detected by the detection unit from the plurality of modes corresponding to the identification information acquired by the acquisition unit.

16 Claims, 6 Drawing Sheets

IMAGE FORMING APPARATUS

CROSS-REFERENCE TO RELATED APPLICATIONS

This application claims the benefit of Japanese Patent Application No. 2006-095016 filed Mar. 30, 2006 in the Japan Patent Office, the disclosure of which is incorporated herein by reference.

BACKGROUND

The present invention relates to an image forming apparatus which has a plurality of functions such as a scanner function and a photocopy function.

An image forming apparatus known in the art has a plurality of functions such as a scanner function, a photocopy function (printer function), and a facsimile function. The scanner function is used for reading image information recorded on a manuscript. The photocopy function is used for printing image information on a sheet or other printing media. The facsimile function is used for transmitting and receiving image information through a telephone line. This image forming apparatus has a plurality of modes of processes executed by using at least one of these functions. This image forming apparatus is adjusted to obtain information for identifying a user (i.e., an ID of the user) from an RFID chip for execution of processes in the modes.

This image forming apparatus has a mode selection key, an ID acquisition key, and a start key. The mode selection key is pushed to select modes. The ID acquisition key is pushed to obtain an ID from the RFID chip. The start key is pushed to execute processing in each mode. The image forming apparatus stores various settings associated with an ID. The settings includes a FAX setting such as destinations of transmission, a manuscript reading setting, and a sheet printing setting.

When the process in the mode corresponding to the facsimile function of the image forming apparatus (hereinafter abbreviated as facsimile mode) is executed, for example, the facsimile mode is initially selected from the plural modes by operating the mode selection key. Then, an ID is obtained from the RFID chip by operating the ID acquisition key to access the FAX setting. The process in the facsimile mode is thus executed according to the FAX setting by operating the start key.

SUMMARY

According to this type of image forming apparatus, when selecting a desired mode and an accessing setting necessary for execution of the process in the mode, the user is required to carry out operations for selecting the desired mode and for acquiring the ID. Thus, the image forming apparatus is not easily used.

It is desirable to provide an image forming apparatus which is easily operated by the user.

The image forming apparatus preferably includes a process unit, an acquisition unit, a detection unit, and a selection unit.

The process unit executes processes in a plurality of modes corresponding to identification information for identifying a user. The acquisition unit acquires identification information for identifying a user. The detection unit detects presence or absence of an object to be used in at least any one of the plurality of modes. The selection unit selects a mode corresponding to the presence or absence of the object detected by the detection unit from the plurality of modes corresponding to the identification information acquired by the acquisition unit.

BRIEF DESCRIPTION OF THE DRAWINGS

The invention will now be described below, by way of example, with reference to the accompanying drawings, in which.

DESCRIPTION OF THE PREFERRED EMBODIMENT

An embodiment according to the invention is hereinafter described with reference to the appended drawings.

[Overall Structure of Apparatus]

An image forming apparatus 1 is at least provided with functions as image scanner, printer, photocopy, and facsimile.

Figure 1:
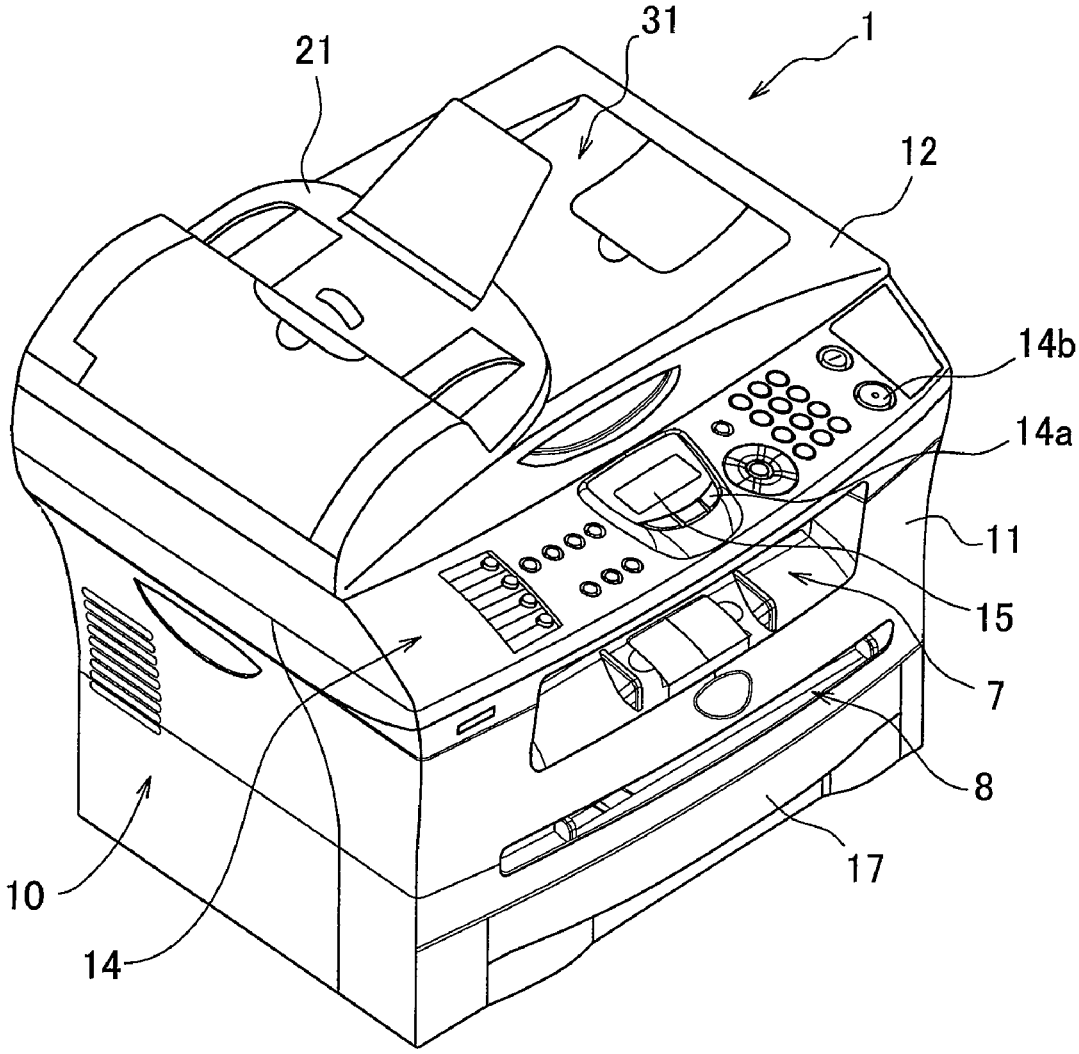
FIG. 1 is a perspective view illustrating an external appearance structure of an image forming apparatus.
Figure 2:
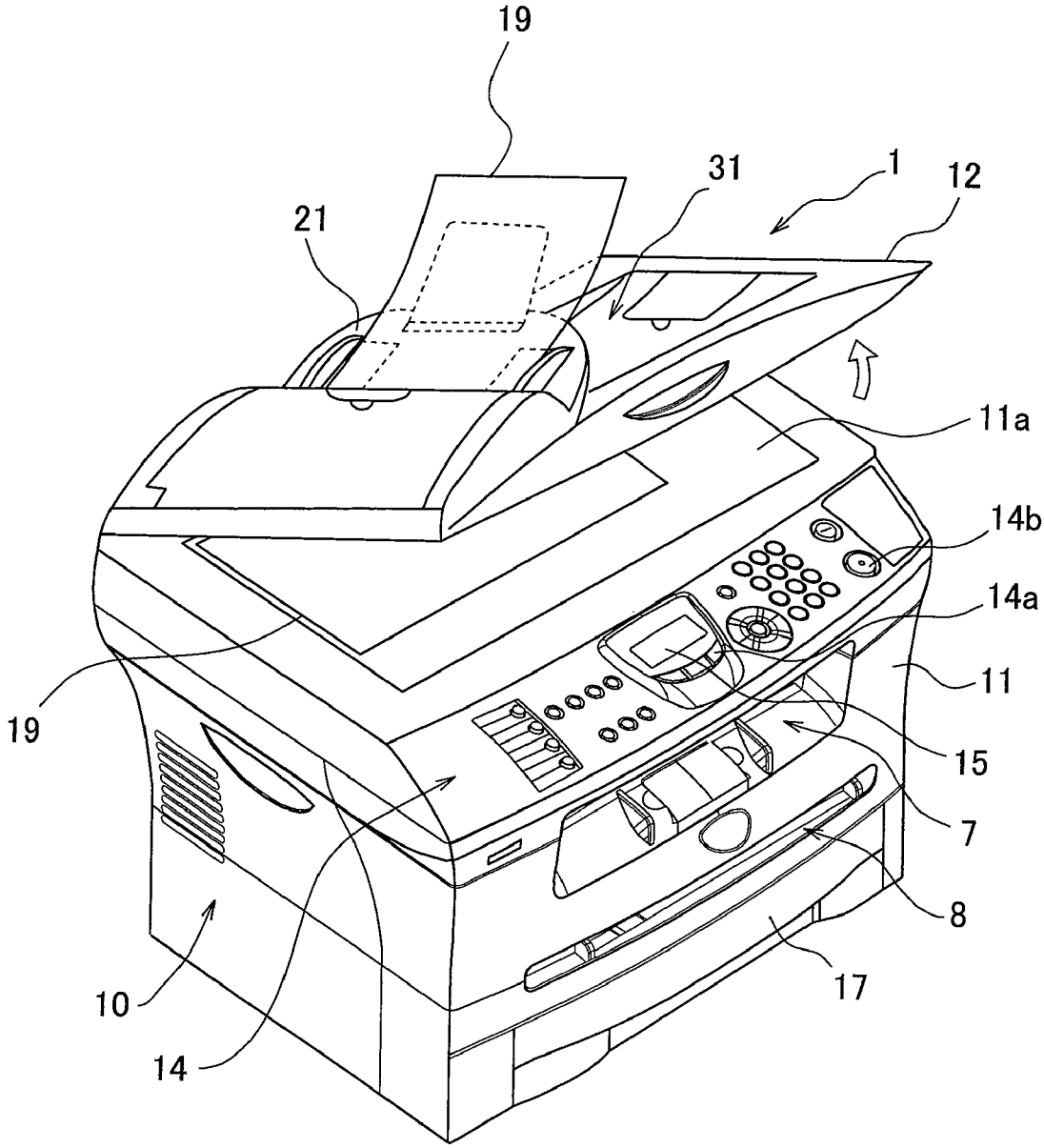
FIG. 2 is a perspective view illustrating the image forming apparatus under a condition in which a main cover of the image forming apparatus is opened.
Figure 3:
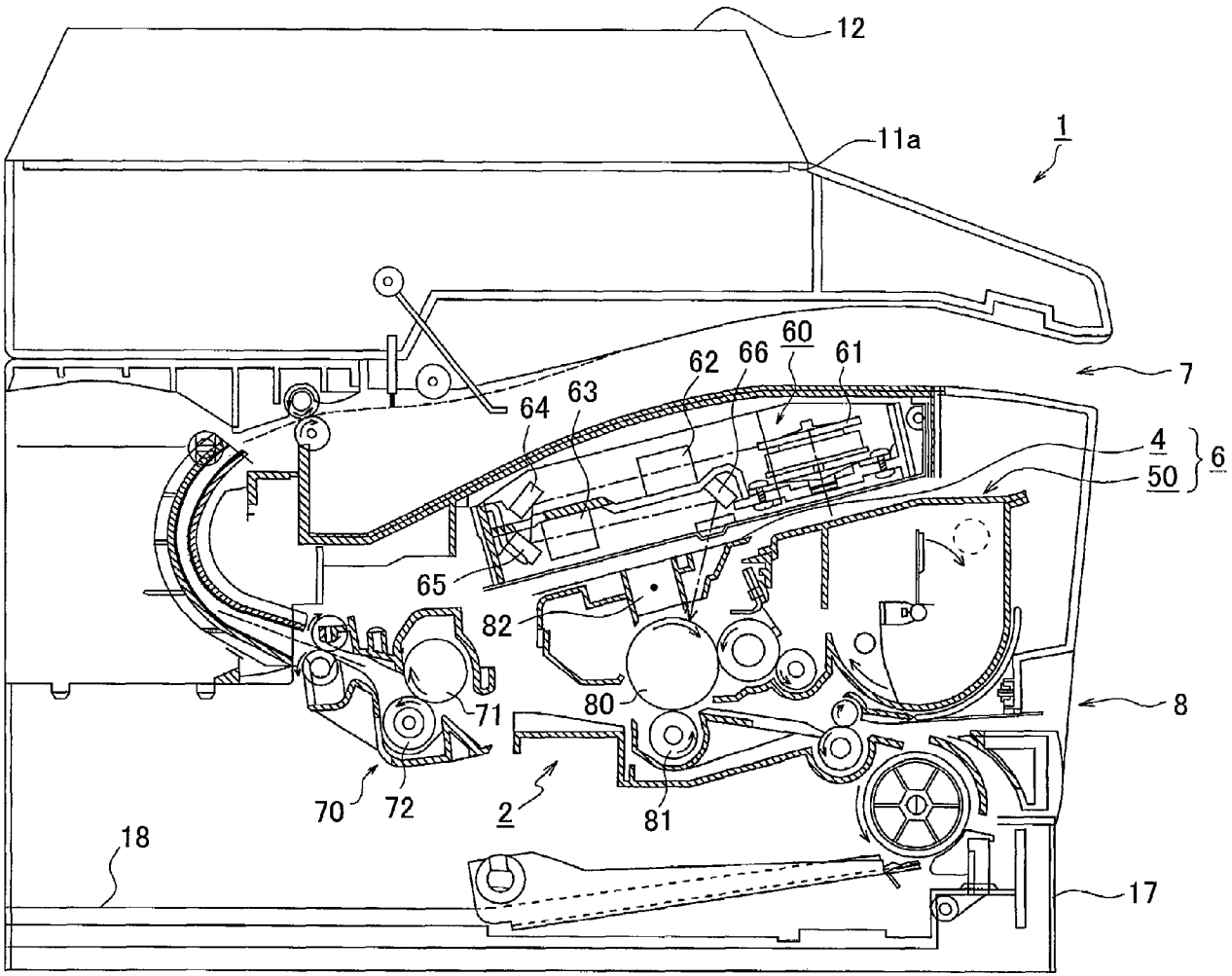
FIG. 3 is a cross-sectional view schematically illustrating an internal structure of the main body of the image forming apparatus.

As shown in FIGS. 1-3, the image forming apparatus 1 includes a sheet tray 17, a main body 10, and a main body cover 12. The sheet tray 17 is used for feeding a sheet 18 subject to printing (see FIG. 3). The main body 10 is used for printing an image obtained by reading information on a manuscript 19 (see FIG. 2) or by other methods on a sheet 18 supplied from the sheet tray 17. The main body cover 12 is openably and closably supported by the main body 10 to cover the entire upper surface of the main body 10.

The main body 10 has a manuscript reading unit 40 (see FIG. 4), an image forming unit 2 (see FIG. 3), and an operation unit 14. The manuscript reading unit 40 is used for reading information provided on a manuscript 19 (hereinafter described as "reading a manuscript 19"). The image forming unit 2 is used for forming an image corresponding to the information read by the manuscript reading unit 40 and printing the image on a sheet 18. Through the operation unit 14, a user inputs information necessary for using the image forming apparatus 1. The manuscript reading unit 40 and the image forming unit 2 are contained in a main body case 11.

The main body case 11 has a reading surface 11*a*, a manually feeding unit 8, and a sheet discharge unit 7. On the reading surface 11*a*, a manuscript 19 having information to be read by the manuscript reading unit 40 is placed. Through the manually feeding unit 8, a sheet 18 is manually supplied to the image forming unit 2 without using the sheet tray 17. Through the sheet discharge unit 7, a sheet 18 after printing by the image forming unit 2 is discharged.

The reading surface 11*a* is a plate-shaped member formed by a light-transmissive material such as glass, and is fixed to the upper surface of the main body case 11 at a position opposed to the main body cover 12.

The operation unit 14 has a selection key 14*a*, a start key 14*b*, and a display unit 15. The selection key 14*a* is used for selecting a function desired by the user from a plurality of functions. The start key 14*b* is used for executing the function selected by the user. The display unit 15 is used for displaying the current condition of the image forming apparatus 1 and the like.

The selection key 14*a* selects a function desired by the user from the functions provided for the image forming apparatus 1. Specific parts of the selection key 14*a* involve a photocopy key for selecting a photocopy function, a facsimile key for selecting a facsimile function, a scanner key for selecting a scanner function, and others.

The display unit 15 is a liquid crystal panel (so-called touch panel) which is pushed when a setting (i.e., information) necessary for printing or other processes is inputted through the display unit 15.

[Structure of Image Forming Unit]

The structure of the image forming unit 2 is now described with reference to the cross-sectional view of FIG. 3.

The image forming unit 2 includes a scanner unit 60, a processing cartridge 6, and a fixing unit 70. The scanner unit 60 is used for emitting laser beams and thereby forming an image. The processing cartridge 6 is used for transferring the image formed by the scanner unit 60 onto a sheet 18. The fixing unit 70 is used for fixing the image transferred on a sheet 18.

The scanner unit 60 of the image forming unit 2 has a laser diode (not shown) which emits laser beams used for forming an electrostatic latent image on a photosensitive drum 80 to be described later, a polygon mirror 61 rotated in such a manner as to reflect the laser beams emitted from the laser diode, and an optical unit having lenses 62 and 63 for converging the laser beams, reflection mirrors 64, 65 and 66 and others. In the scanner unit 60, the laser beams emitted from the laser diode are deflected by the polygon mirror 61 and converged by the optical unit. After the optical path of the laser beams is changed by the optical unit, the laser beams are applied to the surface of the photosensitive drum 80 by high-speed scanning.

The processing cartridge 6 has a drum cartridge 4 and a developing cartridge 50. The developing cartridge 50 is detachably attached to the drum cartridge 4 to accommodate toner (not shown). Both of the drum cartridge 4 and the developing cartridge 50 are used for image forming processing (electrification, development and transfer).

The drum cartridge 4 is a component to which laser beams are applied. The drum cartridge 4 includes the photosensitive drum 80, an electrifier 82, and a transfer roller 81. On the photosensitive drum 80, a toner image to be transferred onto a sheet 18 is formed. The electrifier 82 is used for electrifying the photosensitive drum 80. The transfer roller 81 is used for transferring the toner image carried on the photosensitive drum 80 onto the sheet 18. The toner image is transferred onto a sheet 18 while the sheet 18 is passing between the photosensitive drum 80 and the transfer roller 81.

The fixing unit 70 has a heating roller 71 and a pressing roller 72. The toner image transferred in the press-contact area between the photosensitive drum 80 and the transfer roller 81 is heated and pressed while conveyed between the heating roller 71 and the pressing roller 72, and thereby the toner image is fixed to a sheet 18.

In the image forming unit 2, therefore, an image formed using laser beams emitted from the scanner unit 60 is transferred to a sheet 18 supplied from the sheet tray 17 while the sheet 18 is passing through the processing cartridge 6. Then, the image is fixed to the sheet 18 while the sheet 18 is passing through the fixing unit 70.

[Structure of Main Body Cover and Manuscript Reading Unit]

Figure 4:
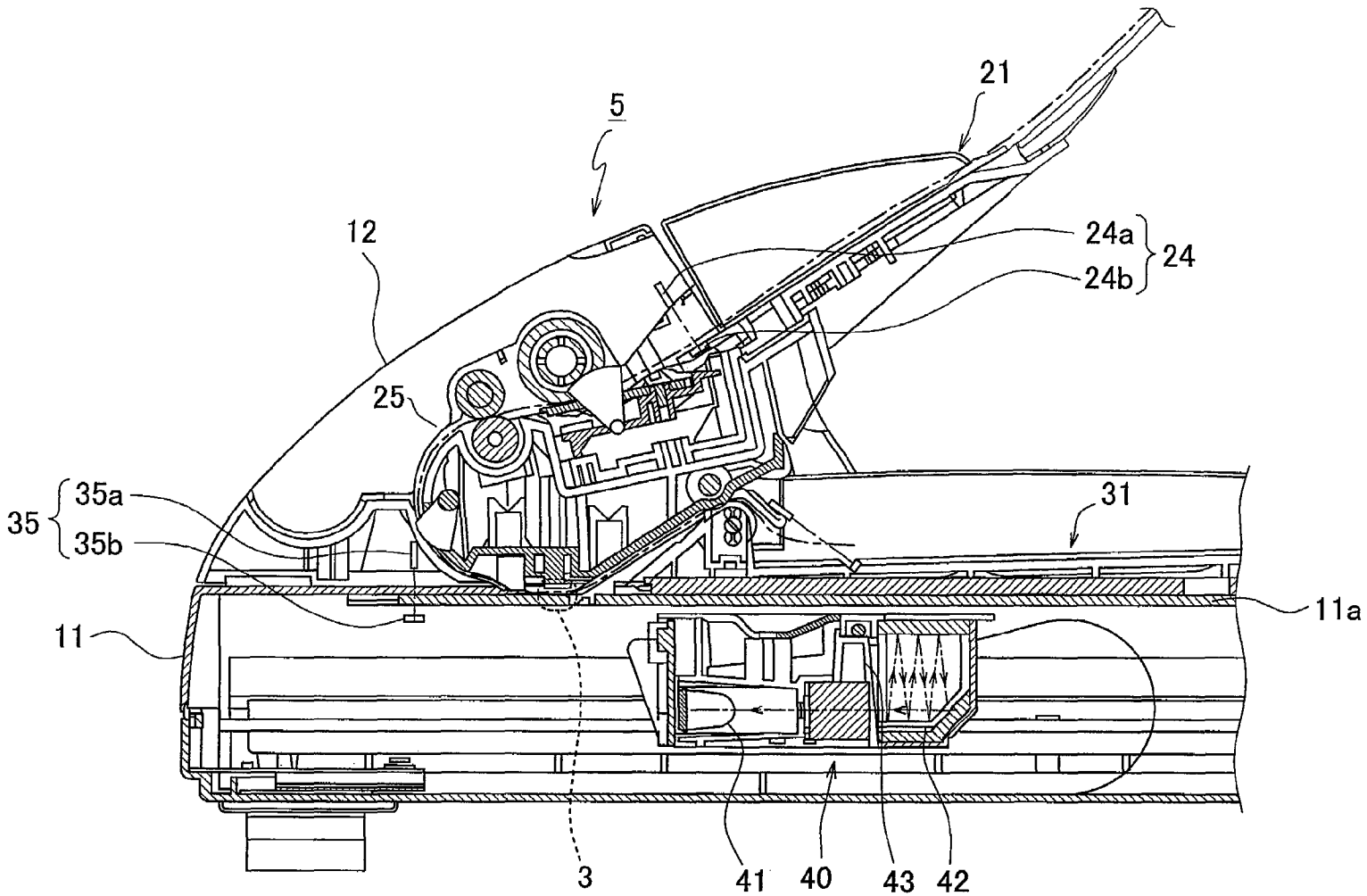
FIG. 4 is a cross-sectional view schematically illustrating the structures of the main cover and a manuscript reading unit of the image forming apparatus.

As shown in FIG. 4, the main body cover 12 includes a carrying portion 21, a conveying portion 25, and an accumulating portion 31. On the carrying portion 21, a manuscript 19 before read by the manuscript reading unit 40 is placed. On the accumulating portion 31, the manuscript 19 after read by the manuscript reading unit 40 is accumulated. The conveying portion 25 is used for conveying the manuscript 19 from the carrying portion 21 through the reading surface 11*a* to the accumulating portion 31 (that is, conveying the manuscript 19 to the accumulating portion 31 after the manuscript 19 is read by the manuscript reading unit 40 retained at a manuscript automatic conveyance reading position 3). The unit including the carrying portion 21, the accumulating portion 31, and the conveying portion 25 is hereinafter referred to as a manuscript automatic conveyance device 5.

As illustrated in FIG. 4, the manuscript reading unit 40 includes a light source 43, an optical element group 42, and an image sensor 41. The light source 43 is used for emitting light toward a manuscript 19. The optical element group 42 includes components such as mirrors and lenses for converging reflection light reflected by the manuscript 19. The image sensor 41 is used for reading information from the manuscript 19. In the manuscript reading unit 40, light emitted from the light source 43 is reflected by the manuscript 19, and the reflected light is converged by the optical element group 42. Then, the converged reflection light is recognized by the image sensor 41 so that the manuscript 19 can be read by the manuscript reading unit 40.

When the manuscript reading unit 40 is disposed at a position opposed to the manuscript automatic conveyance reading position 3, the manuscript reading unit 40 can read the manuscript 19. The manuscript reading unit 40 can be moved in the longitudinal direction of the main body case 11 (left-and-right direction in FIG. 4) along the reading surface 11*a* by a not-shown manuscript reading unit driving mechanism.

In reading a manuscript 19 using the manuscript automatic conveyance device 5, the manuscript reading unit 40 is retained at the position opposed to the manuscript automatic conveyance reading position 3, where the manuscript reading unit 40 reads all the information contained in the manuscript 19 conveyed to pass through the manuscript automatic conveyance reading position 3 by the manuscript automatic conveyance device 5.

In reading a manuscript 19 disposed to cover the reading surface 11*a* (using the image forming apparatus 1 as a flat-bed-type image scanner), the manuscript reading unit 40 reads all the information on the manuscript 19 disposed on the reading surface 11*a* while the manuscript reading unit 40 is moved by the manuscript reading unit driving mechanism.

[Structure of Manuscript Detection Sensor]

A manuscript detection sensor for detecting the presence of a manuscript 19 to be read by the manuscript reading unit 40 is now described with reference to FIG. 4.

A manuscript detection sensor 92 (see FIG. 5) includes a carrying portion detection sensor 24, and a reading surface detection sensor 35. The carrying portion detection sensor 24 is used for detecting a condition in which a manuscript 19 is placed on the carrying portion 21. The reading surface detection sensor 35 is used for detecting a condition in which a manuscript 19 is placed on the reading surface 11*a*.

The carrying portion detection sensor 24 is an optical sensor having a light emitting member 24*a* and a light receiving member 24*b*. The reading surface detection sensor 35 is an optical sensor having a light emitting member 35*a* and a light receiving member 35*b*. The opposed pair of the light emitting member 24*a* and light receiving member 24*b* is disposed such that light emitted from the light emitting member 24*a* toward the light receiving member 24*b* can be blocked by the manuscript 19 placed on the carrying portion 21. The opposed pair of the light emitting member 34*a* and light receiving member 35*b* is disposed such that light emitted from the light emitting member 35*a* toward the light receiving member 35*b* can be blocked by the manuscript 19 placed on the reading surface 11*a*.

According to the structure of the reading surface detection sensor 35, the light receiving member 35*b* is disposed at a position away from the moving route along which the manuscript reading unit 40 is moved within the main body case 11. The light emitting member 35*a* is disposed within the main cover 12. Thus, the reading surface detection sensor 35 is structured such that the light emitted from the light emitting member 35*a* can be received by the light receiving member 35*b* only under a condition in which the main body cover 12 is closed.

According to the manuscript detection sensor 92 explained as above, light emitted from the light emitting member 24*a* or 35*a* is detected by the light receiving member 24*b* or 35*b* when a manuscript 19 is not present at a position corresponding to the manuscript detection sensor 92 (24 or 35). As a result, a receipt signal having a relatively large signal level is outputted from the light receiving member 24*b* or 35*b*. On the other hand, the light emitted from the light emitting member 24*a* or 35*a* is blocked by a manuscript 19 and thus the light is not detected by the light receiving member 24*b* or 35*b* when a manuscript 19 is present at a position corresponding to the manuscript detection sensor 92 (24 or 35). As a result, a receipt signal having a relatively small signal level is outputted from the light receiving member 24*b* or 35*b*.

The manuscript detection sensor 92 is structured such that a CPU 103 to be described later (see FIG. 5) recognizes presence or absence of a manuscript 19 based on a difference in signal level of the receipt signal outputted from the light receiving member 24*b* or 35*b*. The difference in the signal level is caused due to the difference between the presence and absence of the manuscript 19.

[Description of Electric Parts]

Figure 5:
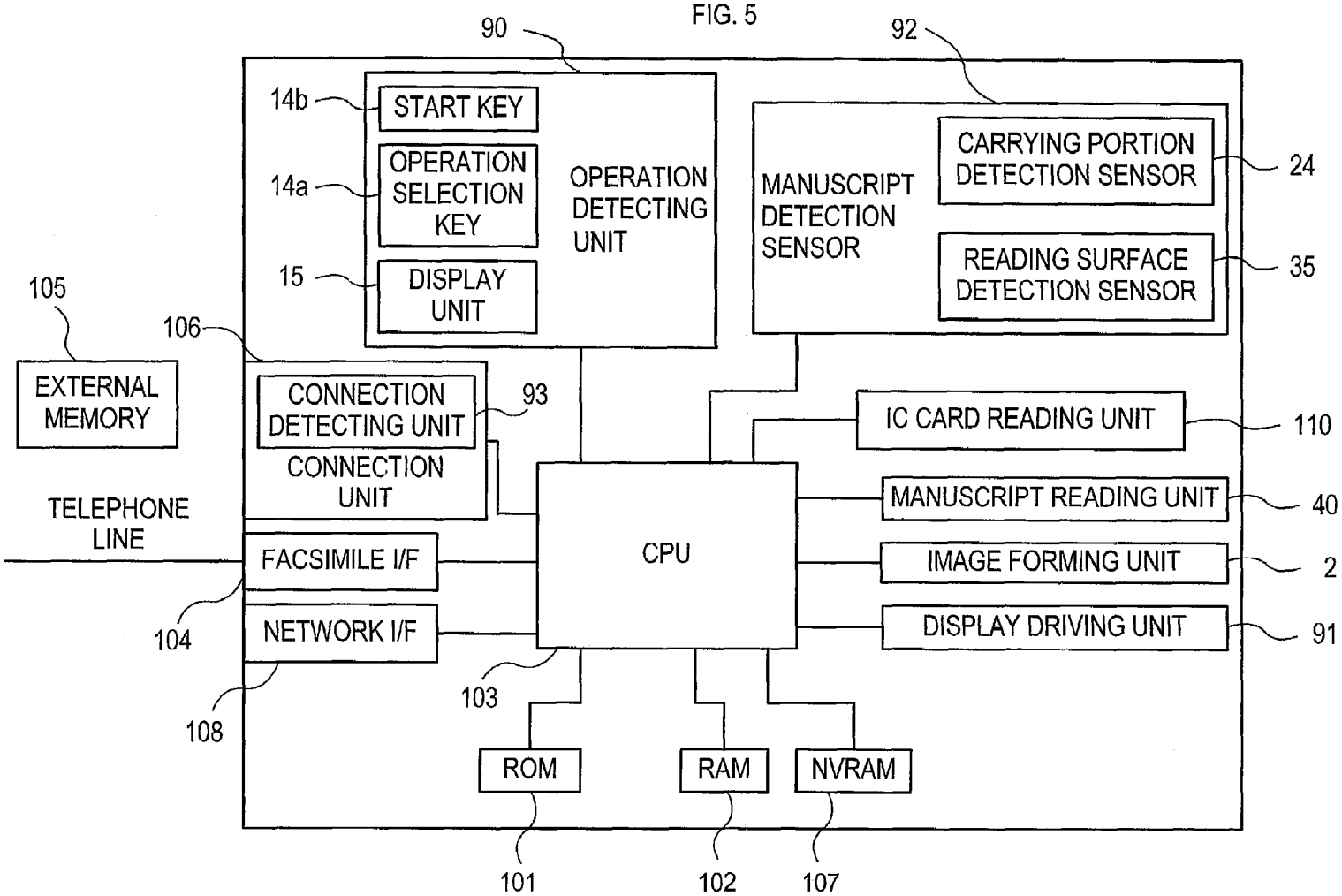
FIG. 5 is a block diagram showing a control system of the image forming apparatus.

As shown in FIG. 5, the image forming apparatus 1 includes a network interface (network I/F) 108, a facsimile interface (facsimile I/F) 104, a connection unit 106, an IC card reading unit 110, a ROM 101, a RAM 102, an NVRAM (non-volatile memory) 107, and the CPU 103. The network I/F 108 is used for connecting the image forming apparatus 1 with an external device (not shown) such as a personal computer. The facsimile I/F 104 is used for connecting the image forming apparatus 1 with a telephone line. To the connection unit 106, a readable and writable external memory 105 is detachably attached. The IC card reading unit 110 is used for reading an ID allocated to each user from an IC card. The ROM 101 is used for storing processing programs for controlling various operations of the image forming apparatus 1. The RAM 102 is used for temporarily storing printing data used in printing an image, process results and others. The NVRAM 107 is used for storing data needed to be retained even after the power is off. The CPU 103 is used for executing the processing programs stored in the ROM 101.

The CPU 103 is connected with the manuscript reading unit 40, the image forming unit 2, a display driving unit 91, an operation detecting unit 90, and the manuscript detection sensor 92. The display driving unit 91 controls the display unit 15 such that an image is shown on the display unit 15. The operation detecting unit 90 detects the operated condition of the operation unit 14.

The connection unit 106 energizes the external memory 105 when the external memory 105 is attached to the connection unit 106. The connection unit 106 includes a connection detecting unit 93 for detecting the attachment of the external memory 105 to the connection unit 106. Image data stored in the external memory 105 may include data having a general-purpose image format, such as a JPEG format, a TIFF format and other formats, data produced by using an ordinary word processing software, document data of PDF type or other types, filed printing data outputted from a print driver, or other data.

The IC card reading unit 110 is a known unit for acquiring information such as an ID from a non-contact-type IC card positioned in the vicinity of the IC card reading unit 110.

According to the image forming apparatus 1, the user can set identification information for identifying the user (i.e., ID) in correspondence with information stored in the IC card in advance by operating the operation unit 14.

[Mode]

Modes provided for the multi-function apparatus 1 (the image forming apparatus 1) are now described.

The multi-function apparatus 1 has operation modes at least as image scanner, printer, photocopy, and facsimile. A plurality of types of modes each of which executes a series of processes containing at least one of these operation modes are prepared in advance for the multi-function apparatus 1.

The modes prepared for the multi-function apparatus 1 involve a scanner mode, a photocopy mode, a FAX mode, and a print mode. The scanner mode is used for storing an image read from a manuscript 19 as image data. The photocopy mode is used for printing an image read from a manuscript 19 on a sheet 18. The FAX mode is used for transmitting an image read from a manuscript 19 through a telephone line. The print mode is used for printing an image corresponding to image data stored in the RAM 102 of the multi-function apparatus 1 on a sheet 18.

Other modes prepared for the multi-function apparatus 1 are a scan-to-memory mode, and a direct print mode. The scan-to-memory mode is used for storing an image read from a manuscript 19 in an external memory 105 connected with the connection unit 106 as image data. The direct print mode is used for reading image data from an external memory 105 connected with the connection unit 106 and printing an image corresponding to the image data on a sheet 18.

Further modes prepared for the multi-function apparatus 1 include a secure print mode, a user specifying mode, and a setting mode. The secure print mode is used for storing printing data with an ID attached therewith transmitted from an external device such as a personal computer into the RAM 102 and printing an image corresponding to the printing data on a sheet 18 when an ID read from the IC card reading unit 110 coincides with the ID attached to the printing data. The user specifying mode is used for selecting one of the plural types of modes and shifting to the selected mode at the start of the image forming apparatus 1 (photocopy mode in this embodiment). The setting mode is used as a mode containing at least a process for storing an image read from a manuscript 19 as image data (i.e., a mode containing a scanner mode).

One of the plural modes prepared for the image forming apparatus 1 may be selected and set as the user specifying mode in advance through the operation of the operation unit 14 by a user of the image forming apparatus 1.

Each of the modes explained above has a setting screen which is displayed on the display unit 15 at the time of selection of a corresponding mode. Through the setting screen, a screen setting necessary for executing a process in the corresponding mode (hereinafter referred to as a macro setting) can be inputted.

In a mode selection and execution process to be described later, the macro setting is stored in the NVRAM 107 in correspondence with an ID.

More specifically, a form and a resolution of image data to be stored or the like may be stored as the macro setting for the scanner mode. A type and number of the sheet 18 for printing or the like may be stored as the macro setting for the photocopy mode. A destination of transmission or the like may be stored as the macro setting for the FAX mode. A type and number of the sheet 18 subject to printing or the like may be stored as the macro setting for the print mode. A form and storing folder of image data to be stored or the like may be stored as the macro setting for the scan-to-memory mode. A designation of image data to be read in image data stored in an external memory, a number of the sheet 18 for printing or the like may be stored as the macro setting for the direct print mode. A number of the sheet 18 for printing or the like may be stored as the macro setting for the secure print mode.

In the setting mode, after completion of the process for storing the image read from a manuscript 19 as the image data, a macro mode is prepared as a mode to be set for executing a process based on the stored image data.

As the macro mode, a scan-to-PDF mode, a transmission mode (i.e., FAX mode), and a printing mode (i.e., photocopy mode) can be set. The scan-to-PDF mode is a mode including the setting mode and the macro mode. The scan-to-PDF mode is used for storing image data as document data such as PDF data and transmitting the document data through a network line. The transmission mode is used for transmitting image data through a telephone line. The printing mode is used for printing an image corresponding to image data on a sheet 18.

In this embodiment, the scan-to-PDF mode is set as the setting mode (including modes up to the macro mode).

In the macro setting of the scan-to-PDF mode, setting information such as a destination address of transmission necessary for executing the macro mode is stored.

In the image forming apparatus 1, the correspondence between the modes prepared in advance and an ID is established when the macro settings for the respective modes are stored.

The CPU 103 executes the mode selection and execution process for selecting one of the plural types of modes prepared in advance based on the presence or absence of the printing data stored in the RAM 102 and information obtained from the manuscript detection sensor 92, the connection detecting unit 93 or others, and for executing the process in the selected mode according to the macro setting.

The mode selected by pushing the selection key 14*a* is set to have priority over the mode selected in advance by the mode selection and execution process.

When the start key 14*b* is pushed, the process in the mode selected at that moment is performed prior to the mode selection and execution process.

In the image forming apparatus 1, selection and execution of a certain mode may be prohibited (not allowed) when the selection key 14*a* or the start key 14*b* is pressed so as to select one mode and execute the same. This is caused because, for example, no macro settings are provided (that is, no correspondence is established between the mode desired to be selected and an ID). In such case, a warning screen is displayed on the display unit 15 so as to indicate a warning corresponding to a cause.

[Mode Selection and Execution Process]

Figure 6:
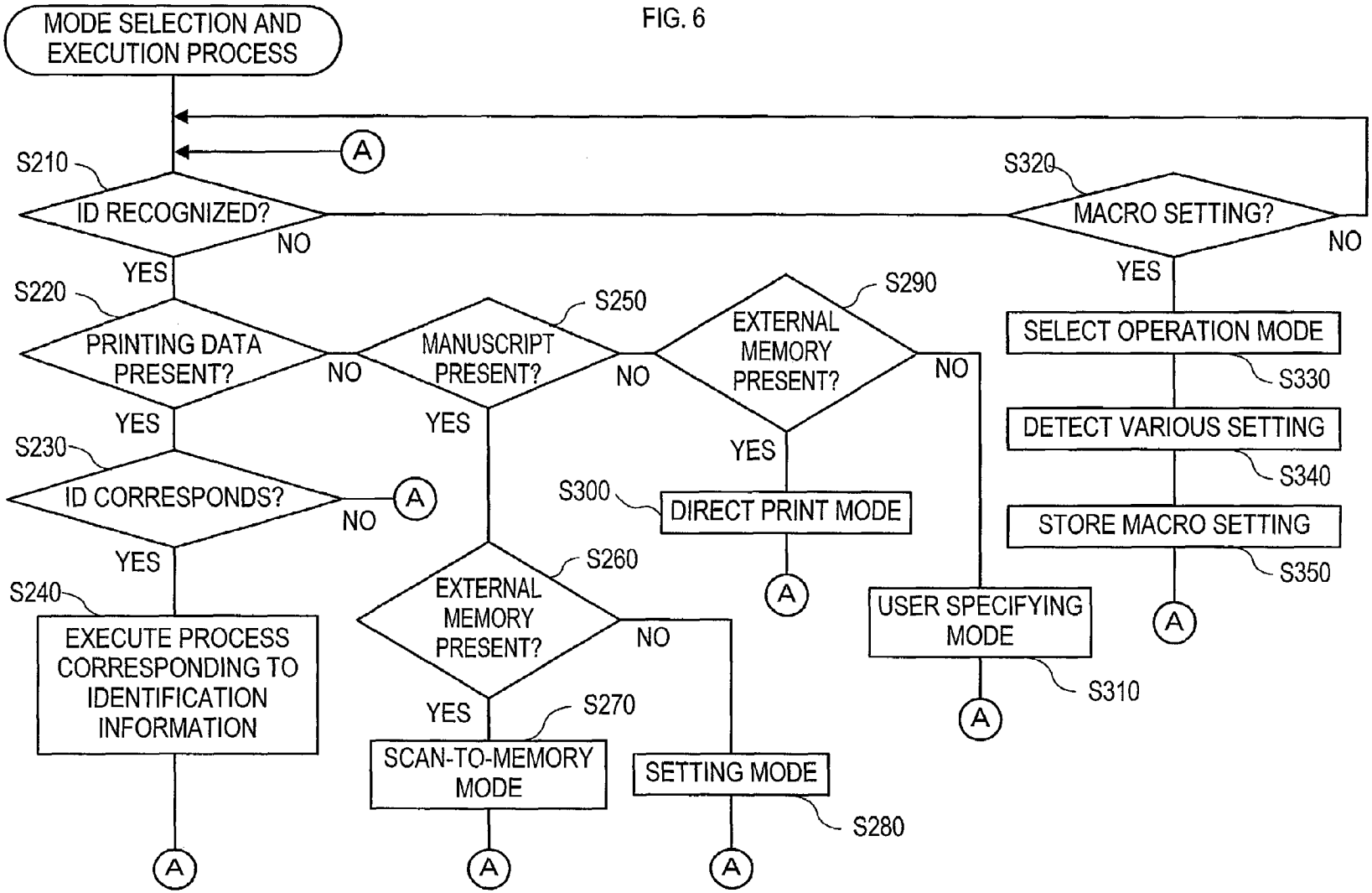
FIG. 6 is a flowchart showing a mode selection and execution process for selecting a mode and executing a process in the selected mode.

The mode selection and execution process performed by the CPU 103 is now explained with reference to the flowchart shown in FIG. 6.

When the mode selection and execution process is executed, it is initially determined whether an ID of a user has been acquired or not in S210. When it is determined that the ID has been acquired (S210:YES), the process proceeds to S220.

In S220, it is determined whether printing data is stored in the RAM 102. More specifically, it is determined whether at least one printing data, with respect to which execution of a printing process is allowed, is included in all the data stored in the RAM 102 by analyzing identifiers (i.e., extensions) indicating attributes of the data, and the contents of the data.

When it is determined that printing data is stored in S220 (S220:YES), the process proceeds to S230.

In S230, it is determined whether printing data (so-called secure data) having an ID corresponding to the ID acquired in S210 is stored in the RAM 102. When it is determined that printing data having an ID corresponding to the ID acquired in S210 is stored (S230:YES), the process proceeds to S240.

In S240, the secure print mode is selected from the plural modes, and a setting screen corresponding to the secure print mode is displayed on the display unit 15. Then, the process in the secure print mode is executed according to a corresponding macro setting. After completion of this process, the process returns to S210.

When it is determined that printing data having the ID corresponding to the ID acquired in S210 is not stored in S230 (S230:NO), the process returns to S210. Specifically, when printing data having the corresponding ID is not stored in the RAM 102 or when only printing data having an ID different from the ID acquired in S210 is stored in the RAM 102, the process returns to S210.

When it is determined that no printing data is stored in S220 (S220:NO), the process proceeds to S250.

In S250, receipt signals are obtained from the carrying portion detection sensor 24 and the reading surface detection sensor 35, and it is determined whether a manuscript 19 is placed on at least either the carrying portion 21 or the reading surface 11*a* or not. When it is determined that a manuscript 19 is placed on either the carrying portion 21 or the reading surface 11*a* or on both (S250:YES), the process proceeds to S260.

In S260, a detection result is obtained from the connection detecting unit 93, and it is determined whether an external memory 105 is connected to the connection unit 106 or not. When it is determined that an external memory 105 is connected (S260:YES), the process proceeds to S270.

In S270, the scan-to-memory mode is selected from the plural modes, and a setting screen corresponding to the scan-to-memory mode is displayed on the display unit 15. Then, the process in the scan-to-memory mode is executed according to a corresponding macro setting.

However, in a condition where the macro setting corresponding to the ID acquired in S210 is not set, warning information indicating this condition is displayed in the display unit 15 (in this embodiment, when no macro setting is set for each mode selected in this process, warning information is displayed on the display unit). Then, the process returns to S210.

When it is determined that an external memory 105 is not connected in S260 (S260:NO), the process proceeds to S280.

In S280, the setting mode is selected from the plural modes, a setting screen corresponding to the setting mode is displayed on the display unit 15. Then, the process in the setting mode is executed according to a corresponding macro setting. In this embodiment, since the scan-to-PDF mode is set as the macro mode, the process in the scan-to-PDF mode is performed. Then, the process returns to S210.

When it is determined that the manuscript 19 is not placed on the carrying portion 21 nor on the reading surface 11*a* in S250 (S250:NO), the process proceeds to S290.

In S290, a detection result is obtained from the connection detecting unit 93, and it is determined whether the external memory 105 is connected to the connection unit 106. When it is determined that the external memory 105 is connected (S290:YES), the process proceeds to S300.

In S300, the direct print mode is selected from the plural modes, and a setting screen corresponding to the direct print mode is displayed on the display unit 15. Then, the process in the direct print mode is executed according to a corresponding macro setting. Then, the process returns to S210.

When it is determined that an external memory 105 is not connected in S290 (S290:NO), the process proceeds to S310.

In S310, the user specifying mode is selected from the plural modes, and a setting screen corresponding to the user specifying mode is displayed on the display unit 15. Then, the process returns to S210.

When it is determined that an ID has not been acquired in S210 (S210:NO), the process proceeds to S320. Specifically, when the IC card reading unit 110 cannot recognize an IC card itself or when information acquired from an IC card does not correspond to the identification information stored in the image forming apparatus 1, the process proceeds to S320.

In S320, it is determined whether a macro setting is to be stored or not. Specifically, it is determined whether a button to be pushed when execution of a process for storing a macro setting is desired and displayed on the display screen 15 has been pushed by a user or not. When it is determined that the button has been pushed, it is determined that the user desires to store a macro setting.

When it is determined that the user desires to store a macro setting in S320 (S320:YES), the process proceeds to S330.

In S330, a mode for which the user desires to store a macro setting is predicted and selected based on a use condition of the image forming apparatus 1. Specifically, it is determined whether printing data is stored in the RAM 102, whether a manuscript 19 is placed, and whether an external memory 105 is attached, similarly to the processes from S220 to S310. Then, the process for storing a macro setting corresponding to the mode predicted is performed.

In S340 subsequent to the above step, a setting screen corresponding to the mode selected in S330 is displayed on the display unit 15. Then, the user can operate the setting screen to input a macro setting corresponding to the mode. The inputted macro setting is temporarily stored, and then the process proceeds to S350.

In S350, the IC card reading unit 110 reads an IC card, and the ID read from the IC card is stored in the NVRAM 107 in correspondence with the macro setting set in S340. Then, the process returns to S210.

When it is determined that a macro setting is not to be stored in S320, the process returns to S210. Specifically, when the button for setting a macro setting is not pushed after elapse of a predetermined time or when the information acquired from the IC card does not correspond to identification information, it is determined that a macro setting is not to be stored. Then, the process returns to S210.

When an ID attached to printing data corresponds to an ID read by the IC card reading unit 110 under a condition in which printing data is stored in the RAM 102, it is highly probable that the printing data having the ID is to be printed. Thus, the CPU 103 executes the mode selection and execution process to automatically select the secure print mode and perform the process in the secure print mode according to a macro setting corresponding to an acquired ID.

When a manuscript 19 is placed and an external memory 105 is not attached under a condition in which printing data is not stored in the RAM 102, it is highly probable that only the manuscript 19 is used. Thus, the CPU 103 executes the mode selection and execution process to select the setting mode and perform the process in the setting mode according to a macro setting corresponding to an acquired ID.

When a manuscript 19 is placed and an external memory 105 is attached under a condition in which printing data is not stored in the RAM 102, it is highly probable that both the manuscript 19 and the external memory 105 are used. Thus, the CPU 103 executes the mode selection and execution process to select the scan-to-memory mode and perform the process in the scan-to-memory mode according to a macro setting corresponding to an acquired ID.

When a manuscript 19 is not placed and an external memory 105 is attached under a condition in which printing data is not stored in the RAM 102, it is highly probable that only the external memory 105 is used. Thus, the CPU 103 executes the mode selection and execution process to select the direct print mode and perform the process in the direct print mode according to a macro setting corresponding to an acquired ID.

When a manuscript 19 is not placed and an external memory 105 is not attached under a condition in which printing data is not stored in the RAM 102, the CPU 103 executes the mode selection and execution process to select the user specifying mode.

[Advantages in this Embodiment]

As explained above, the image forming apparatus 1 in this embodiment predicts and selects a mode desired by a user based on presence or absence of printing data stored in the RAM 102 or on a use condition of the image forming apparatus 1 concerning presence or absence of a manuscript 19 and an external memory 105 or on other conditions. Then, the image forming apparatus 1 executes the process in the selected mode according to a macro setting corresponding to an acquired ID. Thus, the image forming apparatus 1 eliminates the necessity for mode switching operation and inputting operation of a setting information for performing the process in a corresponding mode. As a result, the image forming apparatus 1 can be more easily used.

Particularly, the image forming apparatus 1 in this embodiment can perform the processes in the respective modes according to settings desired by a user since a macro setting is stored in correspondence with an ID.

MODIFIED EXAMPLES

It should be understood that within the scope and spirit of the appended claims, the present invention may be practiced otherwise than as specifically described herein.

For example, while the image forming apparatus 1 in the above embodiment reads and acquires an ID stored in an IC card, an ID may be acquired through an operation of the operation unit 14 by a user.

According to the mode selection and execution process in the above embodiment, the secure print mode is selected when an ID attached to printing data corresponds to an ID read by the IC card reading unit 110 under a condition in which printing data is stored in the RAM 102. However, an executed process in a mode according to a use condition of the image forming apparatus 1 is not limited to the process in the secure print mode.

For example, printing data may contain sheet size data for printing. In this case, the image forming apparatus 1 may execute printing only when a sheet 18 of a size corresponding to the sheet size data is supplied to the image forming unit 2 (that is, only when a sheet of a size corresponding to the sheet size data exists on the sheet tray 17 or on the manually feeding unit 8).

In the above embodiment, the scan-to-PDF mode is set as the setting mode of the image forming apparatus 1. However, some other mode such as the photocopy mode and the FAX mode may be set instead.

The image forming apparatus 1 may be constituted such that a user can select a selection mode in S280 in the mode selection and execution process. For example, selection buttons for the scan-to-PDF mode, the photocopy mode, the FAX mode and other modes are displayed on the display unit 14. The process in the mode selected by pushing the corresponding selection button is executed according to a macro setting corresponding to an ID.

In the user specifying mode of the image forming apparatus 1 in the above embodiment, one of the plural types of modes is selected and set by operating the operation unit 14. However, a mode frequently used may be set as the user specifying mode based on the number of times of use counted for each mode used by the image forming apparatus 1 (counted as the number of times corresponding to each ID, for example). In addition, the user specifying mode of the image forming apparatus 1 is not limited to a mode set by a user of the image forming apparatus 1, but may be set during manufacture of the image forming apparatus 1.

In the mode selection and execution process in the above embodiment, the setting screen corresponding to each mode is displayed on the display unit 15 at the time of execution of the process in the corresponding mode (S240, S270, S280, S300 or other steps). It is possible, however, to equip a speaker on the image forming apparatus 1 and provide voice information about the contents of the operation in addition to the display.

According to the mode selection and execution process in the above embodiment, for detecting a use condition of the image forming apparatus 1, presence or absence of a manuscript 19 and an external memory 105 is detected after detection of presence or absence of printing data. However, these detections may be carried out in different order if at least presence or absence of printing data, a manuscript 19 and an external memory 105 is detected.

In the above embodiment, a mode for a macro setting is selected based on a use condition of the image forming apparatus 1 in the mode selection and execution process. However, the mode selection method is not limited to this method. For example, a mode for a macro setting may be selected by pushing one of plural buttons displayed on the display unit 15 in S330.

An external memory 105 may be any type of device if it can store image data. For example, an ordinary hard disk, a recording medium connectable through USB, a SMART MEDIA and a COMPACT FLASH®, and other media may be used.

What is claimed is:

1. An image forming apparatus, comprising:

a process unit that executes processes in a plurality of modes corresponding to identification information for identifying a user;

an acquisition unit that acquires identification information for identifying a user;

a detection unit that detects presence or absence of an object to be used in at least any one of the plurality of modes; and a selection unit that selects a mode corresponding to the presence or absence of the object detected by the detection unit from the plurality of modes corresponding to the identification information acquired by the acquisition unit.

2. The image forming apparatus according to claim 1, wherein the detection unit includes an image detection unit that detects presence or absence of identification image information corresponding to the identification information acquired by the acquisition unit.

3. The image forming apparatus according to claim 2, wherein:

the plurality of modes include a process mode in which the identification image information is printed; and the selection unit selects the process mode when the detection unit detects the identification image information under a condition in which the process mode corresponds to the identification information acquired by the acquisition unit.

4. The image forming apparatus according to claim 1, further including a carrying portion on which a manuscript is placed, wherein the detection unit includes a manuscript detection unit that detects presence or absence of a manuscript placed on the carrying portion.

5. The image forming apparatus according to claim 4, wherein:

the plurality of modes include a process mode in which image information is read from a manuscript; and the selection unit selects the process mode when the manuscript detection unit detects a manuscript under a condition in which the process mode corresponds to the identification information acquired by the acquisition unit.

6. The image forming apparatus according to claim 1, further including an attachment unit to which an external storage device capable of storing image information is attached, wherein the detection unit includes an external storage device detection unit that detects presence or absence of an external storage device attached to the attachment unit.

7. The image forming apparatus according to claim 6, wherein:

the plurality of modes include a process mode in which image information stored in the external storage device is read and printed; and the selection unit selects the process mode when the external storage device detection unit detects an external storage device under a condition in which the process mode corresponds to the identification information acquired by the acquisition unit.

8. The image forming apparatus according to claim 1, further including:

an attachment unit to which an external storage device capable of storing image information is attached; and a carrying portion on which a manuscript is placed, wherein the detection unit includes a manuscript detection unit that detects presence or absence of a manuscript placed on the carrying portion, and an external storage device detection unit that detects presence or absence of an external storage device attached to the attachment unit.

9. The image forming apparatus according to claim 8, wherein:

the plurality of modes include a process mode in which image information is read from a manuscript; and the selection unit selects the process mode when the manuscript detection unit detects a manuscript and when the external storage device detection unit does not detect an external storage device under a condition in which the process mode corresponds to the identification information acquired by the acquisition unit.

10. The image forming apparatus according to claim 8, wherein:

the plurality of modes include a process mode in which image information stored in an external storage device is read and printed; and the selection unit selects the process mode when the manuscript detection unit does not detect a manuscript and when the external storage device detection unit detects an external storage device under a condition in which the process mode corresponds to the identification information acquired by the acquisition unit.

11. The image forming apparatus according to claim 8, wherein:

the plurality of modes include a process mode in which image information is read from a manuscript and written to an external storage device; and the selection unit selects the process mode when the manuscript detection unit detects a manuscript and when the external storage device detection unit detects an external storage device under a condition in which the process mode corresponds to the identification information acquired by the acquisition unit.

12. The image forming apparatus according to claim 1, wherein the selection unit selects a predetermined process mode when the detection unit does not detect the object to be used.

13. The image forming apparatus according to claim 1, further including:

a storage unit that stores setting information with respect to a process executed in a mode selected by the selection unit; and a control unit that executes a process in a mode selected by the selection unit according to the setting information stored by the storage unit.

14. The image forming apparatus according to claim 1, further including a notification unit that notifies with respect to information on a mode selected by the selection unit.

15. The image forming apparatus according to claim 1, wherein the acquisition unit acquires the identification information from an external storage medium provided separately from the image forming apparatus.

16. The image forming apparatus according to claim 1, further including a setting unit that sets the identification information, wherein the acquisition unit acquires the identification information set by the setting unit.

* * * * *